US008573951B1

(12) United States Patent
Beckham

(10) Patent No.: US 8,573,951 B1
(45) Date of Patent: Nov. 5, 2013

(54) POOL RECIRCULATION PUMP SAFETY SYSTEM AND METHOD

(75) Inventor: Lewis Steven Beckham, Cortez, FL (US)

(73) Assignee: Play-It-Safe Technologies, LLC, Winter Haven, FL (US)

( * ) Notice: Subject to any disclaimer, the term of this patent is extended or adjusted under 35 U.S.C. 154(b) by 440 days.

(21) Appl. No.: 12/896,190

(22) Filed: Oct. 1, 2010

Related U.S. Application Data

(60) Provisional application No. 61/248,297, filed on Oct. 2, 2009.

(51) Int. Cl.
*F04B 49/10* (2006.01)

(52) U.S. Cl.
USPC ..... 417/12; 4/504; 4/509

(58) Field of Classification Search
USPC ..... 417/12; 4/504, 509
See application file for complete search history.

(56) References Cited

U.S. PATENT DOCUMENTS

| | | | | |
|---|---|---|---|---|
| 4,620,835 | A | 11/1986 | Bell | |
| 5,725,359 | A * | 3/1998 | Dongo et al. | 417/44.9 |
| 6,676,831 | B2 * | 1/2004 | Wolfe | 210/85 |
| 2003/0106147 | A1 * | 6/2003 | Cohen et al. | 4/504 |

* cited by examiner

*Primary Examiner* — Charles Freay
*Assistant Examiner* — Patrick Hamo
(74) *Attorney, Agent, or Firm* — Allen, Dyer, Doppelt, Milbrath & Gilchrist, P.A.

(57) ABSTRACT

A pool recirculation pump safety system includes a power supply assembly operable to selectively supply operating power to a recirculation pump motor, an entrapment detection assembly operable to detect a change in a recirculation system parameter indicative of swimmer entrapment at a suction intake opening, and a timer assembly operable to automatically bypass the entrapment detection assembly for a predetermined time period upon energization of the system. During operation of the recirculation pump motor, the system is configured to secure operating power to the recirculation pump motor upon detection of the indicative recirculation system parameter change after the predetermined time period. The entrapment detection assembly and the timer assembly can be arranged to form a switchable neutral connection for a power relay of the power supply assembly.

14 Claims, 2 Drawing Sheets

POOL RECIRCULATION PUMP SAFETY SYSTEM AND METHOD

CROSS-REFERENCE TO RELATED APPLICATION

This application claims the benefit of U.S. Provisional Application Ser. No. 61/248,297, filed on Oct. 2, 2009, the contents of which are herein incorporated by reference in their entirety.

FIELD OF THE INVENTION

The present invention relates to control systems for pool recirculation pump motors, and more particularly to safety systems and related methods for preventing suction intake entrapment of pool users.

BACKGROUND

Any swimming pool, spa or other manmade body of water using a recirculation pump poses the risk of drowning or incapacitation to a person drawn to the suction intake opening. There are numerous documented events of drownings or injuries caused by persons being drawn to a suction intake opening and becoming unable to escape the suction caused by the pump.

Most recirculation pumps operate with 120 (or 220) volt, single phase electric motors. When these motors are actuated, the attached pumps pull water from the pool and recirculate the water back into the pool. In the recirculation fluid flow circuit there may be filters, heaters and/or other devices through which the water passes. A negative pressure (suction) is generated on the suction side of the pump, and a positive pressure is generated on the discharge side of the pump.

Most common recirculation pump electrical installations consist of a motor control center with circuit breakers feeding electrical current to a timing device having a power relay. The timing device and power relay cooperate to turn the electric pump motor on and off on a predetermined schedule. There will normally be two 120 volt lines (L1 and L2) from the motor control center to the timing device. There will normally be two lines from the timing device (Load 1 and Load 2) to the electrical motor. There should also be a grounding wire (G) grounding the various pieces of equipment. There may or may not be a neutral wire (N). If there are auxiliary devices such as filters these are normally equipped with a pressure gauge for monitoring the water pressure, or pressure differential, at or across said devices.

U.S. Pat. No. 4,620,835 (the '835 patent) discloses an example of a system for protecting a swimming pool electrical motor in the event of a blockage. However, the system of the '835 patent is representative of the shortcomings of various prior art pump protection systems, in that they are not designed with the safety of pool users in mind. For instance, the '835 patent utilizes a manual override to disable the automatic shutoff system when the recirculation pump is coming up to pressure and when the system in being shut down. Also, pneumatic means are utilized for protecting the pump that, were a blockage caused as a result of pool user entrapment, may allow re-established of pump suction before the user is able to completely disengage him- or herself.

SUMMARY OF THE INVENTION

In view of the foregoing, it is an object of the present invention to provide an improved pool recirculation pump safety system and related methods. As used herein, "pool" refers to generally to swimming pools, spas and other water volumes designed to accommodate humans therein.

According to an embodiment of the present invention, a pool recirculation pump safety system includes a power supply assembly operable to selectively supply operating power to a recirculation pump motor, an entrapment detection assembly operable to detect a change in a recirculation system parameter indicative of swimmer entrapment at a suction intake opening, and a timer assembly operable to automatically bypass the entrapment detection assembly for a predetermined time period upon energization of the system. During operation of the recirculation pump motor, the system is configured to secure operating power to the recirculation pump motor upon detection of the indicative recirculation system parameter change after the predetermined time period.

According to additional aspects of the present invention, the power supply assembly can include a power relay having a relay coil, the relay coil permitting supply of power to the recirculation pump motor only when energized. The entrapment detection assembly can include a switch that closes only when the indicative recirculation system parameter reaches a predetermined threshold, the switch being arranged in series with the relay coil. Also, the timer assembly can include a time delay relay that closes only during the predetermined time period, the time delay relay being arranged in series with the relay coil and in parallel with the switch. Advantageously, the switch and the time delay relay can be arranged on a neutral side of the relay coil.

According to a method aspect of the present invention, a method of retrofitting a pool recirculation system with the pool recirculation pump safety system includes installing the entrapment detection assembly at a sensing point in the recirculation system where the change in a parameter indicative of swimmer entrapment at a suction intake opening is detectable, and connecting the entrapment detection assembly to the power supply assembly for the recirculation pump motor, such that the power supply assembly automatically secures power to the recirculation pump motor upon detection of the indicative parameter by the entrapment detection assembly.

According to a further aspect, installing the entrapment detection assembly can include modifying an existing sensing point to accommodate the entrapment detection assembly.

These and other objects, aspects and advantages of the present invention will be better appreciated in view of the drawings and following detailed description of a preferred embodiment.

DETAILED DESCRIPTION OF A PREFERRED EMBODIMENT

Figure 1:
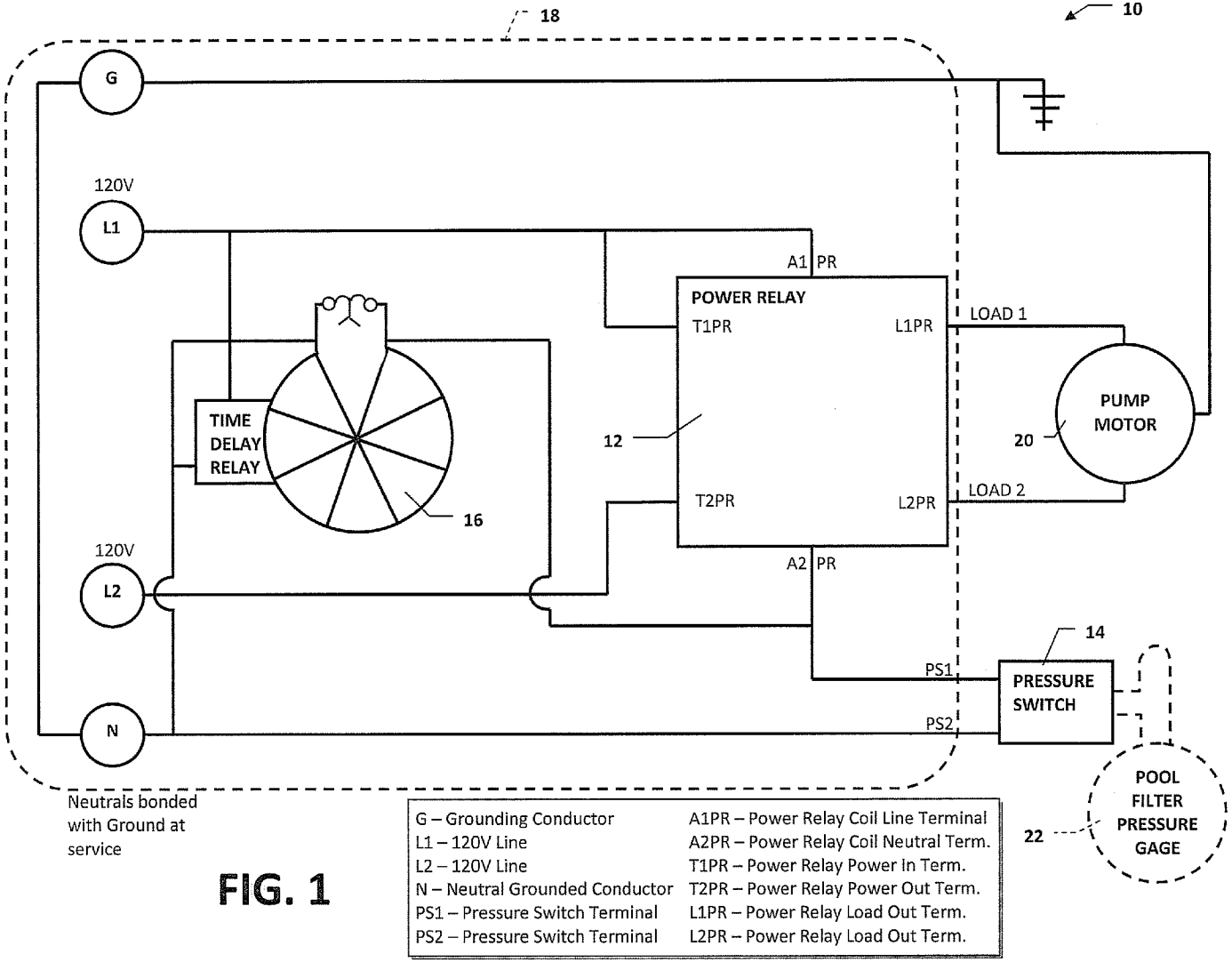
FIG. 1 is a schematic circuit diagram of a pool recirculation pump safety system including a power supply assembly, an entrapment detection assembly, and a timer assembly, according to an embodiment of the present invention.

According to an embodiment of the present invention, a pool recirculation pump safety system 10 includes a power supply assembly 12, an entrapment detection assembly 14, and a timer assembly 16. The power supply assembly 12 and the timer assembly 16 are preferably arranged within one or more weatherproof electrical enclosures 18. An indicator light may be located on the weatherproof enclosure 18 to show the system 10 is activated.

The system 10 is operable to detect an indicative parameter change in the pool recirculation system below a predetermined threshold using the entrapment detection assembly 14, and based thereon, to de-energize the recirculation pump motor 20 using the power supply assembly 12. Upon an intentional start-up of the recirculation pump motor 20, the timer assembly 16 automatically bypasses the entrapment detection assembly 14 for a predetermined time period to allow the recirculation pump motor 20 to come up to speed and for normal system pressure to be established. Following a shut down triggered by the entrapment detection assembly 14, the system must be manually reset before the pump motor 20 can be restarted.

The power supply assembly 12 is operable to selectively supply operating power to a recirculation pump motor 20. In the depicted embodiment, the power supply assembly 12 includes a power relay with a coil that closes normally open load supply contacts only while energized.

The entrapment detection assembly 14 is operable to sense a parameter change in the pool recirculation system indicative of swimmer entrapment at a pool suction intake opening. The indicative parameter change results from a decrease in recirculation system flow, and can include a drop in sensed pressure, differential pressure and/or water flow rate below a predetermined threshold. The entrapment detection assembly 14 preferably includes an appropriate pressure and/or flow sensor with a corresponding switch that closes a normally open contact only when the predetermined threshold is met.

In the depicted embodiment, the entrapment detection assembly 14 includes a pressure switch coupled with a pressure sensor; for instance, attached to a sensing point on a pool filter housing in a position to readily detect pressure transients that would be indicative of an intake suction blockage. The pressure switch is set to close at a predetermined pressure set point indicative of an unobstructed suction intake during normal operation of the recirculation pump and to automatically open below the set point. The pressure switch is electrically connected in the neutral connection leading from the power relay 12.

The timer assembly 16 is operable to close a normally open contact only for a predetermined time following energization, after which predetermined time period, the contact automatically opens. Preferably, the timer assembly 16 must be manually reset after each system 10 de-energization triggered by the entrapment detection assembly 14. The timer assembly 16 can use an analog or a digital timing device. In the depicted embodiment, the timer assembly 16 includes a time delay relay that is powered from one of the line inputs and electrically connected in parallel with the pressure switch of the entrapment detection assembly 14.

Power into the system 10 can further be controlled by a recirculation pump timing device or "pool timer," set by a user to selectively supply power from multiple line inputs to a recirculation pump motor 20 at predetermined intervals; for instance, for a multiple hour duration each day. The pool timer, if used, can share components in common with the system 10; for instance the pool timer can use the same power supply assembly 12 to selectively power the recirculation pump motor. Whether common components are shared or not, the pool timer should not be wired relative to the system 10 such that an automatic restart of the recirculation pump is possible immediately following a entrapment detection assembly 14 shutdown.

In operation of the system 10, the automatic startup assembly 16 allows the motor 20 to start by bypassing the open pressure switch of the entrapment detection assembly 14, temporarily completing the circuit in the neutral connection and allowing the power supply assembly 12 relay coil to energize and supply power to the motor 20. When the motor 20 starts, the pump will build up pressure, closing the pressure switch. Thus, after the timer assembly 16 times out, the entrapment assembly 14 maintains the closed circuit in the neutral connection, allowing the power supply assembly 12 to continue to supply power to the pump motor 20.

When the system 10 is working in a normal mode, it starts and stops when the recirculation pump timing device is automatically activated. If the suction intake is blocked while the pump is running, pressure will quickly fall within the recirculation system. When the pressure drops below the set point of the pressure switch, the switch opens, creating an open circuit, de-energizing the relay coil of the power supply assembly 12 and securing power to the motor 20. When the motor 20 shuts off, the suction from the pump is quickly reduced to zero. If a person has been held to the suction intake opening of the pool, the person will be released quickly. The motor 20 will remain off until the system 10 is manually reactivated.

Figure 2:
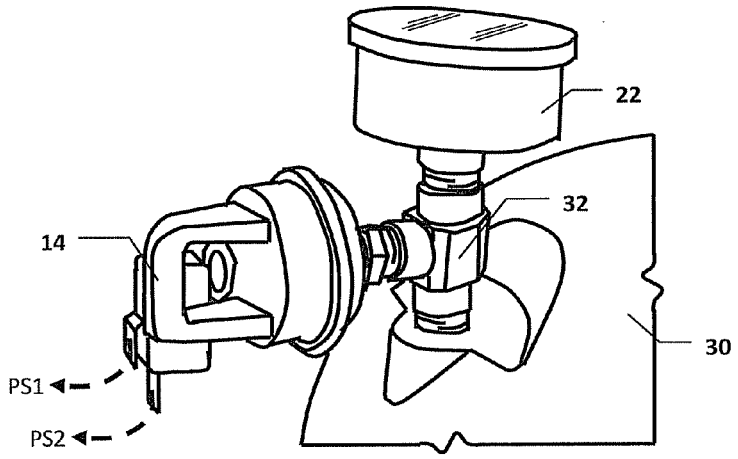
FIG. 2 is a perspective view of the entrapment detection assembly of FIG. 1.

Referring to FIG. 2, in an exemplary installation method for the system 10, if there is a recirculation system parameter sensing device already installed at an appropriate sensing point, such as a pressure gauge 22 on a pool filter housing 30, then the sending device is removed and a "T"-fitting 32 is installed. The device is reattached to one opening of the "T"-fitting 32 and the entrapment detection assembly 14 is attached into the remaining opening of the "T"-fitting 32. If there is not a suitable sensing point available, the entrapment detection assembly 14 is plumbed into the recirculation system piping with appropriate fittings, preferably on the discharge side of the pump.

There are two wires connected with spade connectors to the pressure switch of the entrapment detection assembly 14. One wire (via PS1) is connected to the neutral terminal (N) in the electrical enclosure. The other wire (via PS2) is connected to the A2PR (neutral) on the power relay and to an input on the timer assembly 16 (see FIG. 3). The use of the neutral wires limits the potential of an electric shock outside the enclosure 18 (e.g., at the entrapment detection assembly 14) because there is zero potential between the neutral and ground wires if they are properly bonded at the service origin.

Figure 3:
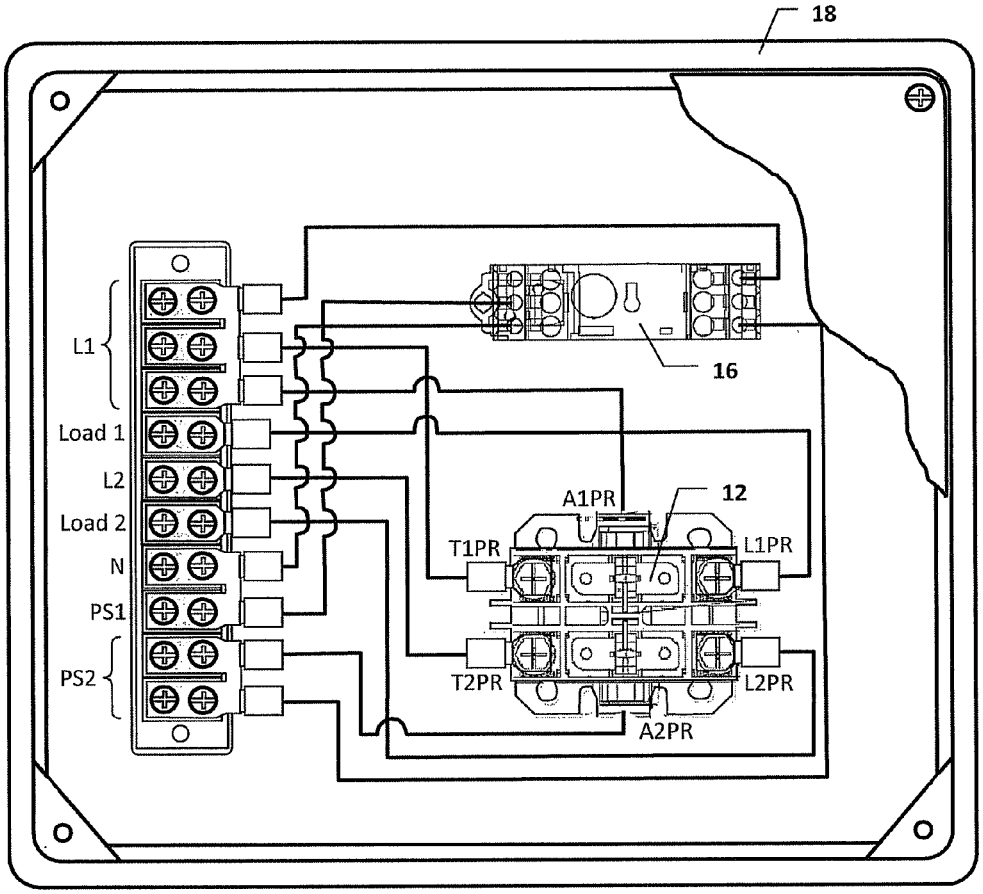
FIG. 3 is a perspective view of the power supply assembly and timer assembly of FIG. 1, within a weatherproof enclosure with a cover partially cut-away to show details.

Referring to FIG. 3, electrical connections within the weatherproof enclosure 18 are explained. Power into the enclosure is wired to the L1 and L2 terminals. Power leaving the enclosure 18 to the pump motor 20 (see FIG. 1) is wired from the Load 1 and Load 2 terminals. As discussed above, the pressure switch of the entrapment detection assembly 14 is wired to terminals PS1 and PS2. The neutral terminal (N) for the enclosure is ultimately bonded to ground (as seen in FIG. 1).

Pump motor power from L1 and L2 is wired to T1PR and T2PR, respectively, on the relay of the power supply assembly 12. Pump motor power from the power relay is wired from L1PR and L2PR to the Load 1 and Load 2 terminals, respectively. Preferably, at least one set of leads are lifted to prevent supply of power to the pump motor until after the operation of the system 10 has been otherwise satisfactorily tested.

Power from L1 is wired to the time delay relay of the timer assembly 16 and to the relay coil of the power supply assembly 12 (at A1PR) to allow the respective energization thereof. The neutral side of the relay coil of the power supply assembly 12 (at A2PR) is wired to both one side of the normally open time delay relay and to the terminal PS2. The other side of the normally open time delay relay and the terminal PS1 are both wired to the N terminal to establish parallel connection of the pressure switch and the time delay relay between the relay coil and the grounded neutral, achieving, in effect, a switchable neutral arrangement.

It will be appreciated from the foregoing that the present invention can provide a pool recirculation pump safety system and method that are effective automatically without requiring a manual override. Additionally, the present invention can provide a recirculation pump safety system and method that will quickly shut off the recirculation pump motor upon detecting a pressure change indicative of entrapment, and that does not risk an inadvertent, immediate restart. Also, the present invention can offer a recirculation pump safety system and method of installation that can be quickly and easily retrofit into existing recirculation pump systems.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described, and of the claims appended hereto.

What is claimed is:

1. A pool recirculation pump safety system comprising:

a power supply assembly operable to selectively supply operating power to a recirculation pump motor;

an entrapment detection assembly operable to detect a change in a recirculation system parameter indicative of swimmer entrapment at a suction intake opening; and a timer assembly operable to automatically bypass the entrapment detection assembly for a predetermined time period upon energization of the system;

wherein, during operation of the recirculation pump motor, the system is configured to secure operating power to the recirculation pump motor upon detection of the indicative recirculation system parameter change after the predetermined time period;

wherein the power supply assembly includes a power relay having a relay coil, the relay coil permitting supply of power to the recirculation pump motor only when energized;

wherein the entrapment detection assembly includes a switch that closes only when the indicative recirculation system parameter rises reaches a predetermined threshold, the switch being arranged in series with the relay coil; and wherein the timer assembly includes a time delay relay that closes only during the predetermined time period, the time delay relay being arranged in series with the relay coil and in parallel with the switch.

2. The system of claim 1, wherein the switch and the time delay relay are arranged on a neutral side of the relay coil.

3. The system of claim 1, wherein the entrapment detection assembly includes at least one of a pressure sensor and a flow sensor coupled with a switch that closes only when the indicative recirculation system parameter rises reaches a predetermined threshold.

4. The system of claim 3, wherein the entrapment detection assembly includes the pressure sensor, and the switch closes only when a sensed recirculation system pressure reaches a predetermined threshold.

5. The system of claim 4, wherein the pressure sensor is adapted for connection to a pre-existing sensing point in the recirculation system.

6. The system of claim 1, wherein the power supply assembly and the timer assembly are commonly arranged in a weatherproof electrical enclosure.

7. A pool recirculation pump safety system comprising:

a power supply assembly operable to selectively supply operating power to a recirculation pump motor;

an entrapment detection assembly operable to detect a change in a recirculation system parameter indicative of swimmer entrapment at a suction intake opening; and a timer assembly operable to automatically bypass the entrapment detection assembly for a predetermined time period upon energization of the system;

wherein, during operation of the recirculation pump motor, the system is configured to secure operating power to the recirculation pump motor upon detection of the indicative recirculation system parameter change after the predetermined time period; and wherein the timer assembly does not automatically bypass the entrapment detection assembly for the predetermined time period upon energization of the system following a shutdown triggered by the entrapment detection assembly.

8. The system of claim 7, wherein the entrapment detection assembly includes at least one of a pressure sensor and a flow sensor coupled with a switch that closes only when the indicative recirculation system parameter rises reaches a predetermined threshold.

9. The system of claim 8, wherein the entrapment detection assembly includes the pressure sensor, and the switch closes only when a sensed recirculation system pressure reaches a predetermined threshold.

10. The system of claim 9, wherein the pressure sensor is adapted for connection to a pre-existing sensing point in the recirculation system.

11. The system of claim 7, wherein the power supply assembly and the timer assembly are commonly arranged in a weatherproof electrical enclosure.

12. A pool recirculation pump safety system comprising:

a power supply assembly including a power relay with a relay coil energizable to close normally open load supply contacts for recirculation pump motor;

an entrapment detection assembly including a sensor and corresponding switch that closes only when a sensed recirculation system parameter reaches a predetermined threshold, the switch being arranged in series with the relay coil; and a timer assembly including a normally open time delay relay that automatically closes for a predetermined time period upon energization of the system, the time delay relay being arranged in series with the relay coil and in parallel with the switch.

13. The system of claim 12, wherein the sensor is a pressure sensor.

14. The system of claim 12, wherein the switch and the time delay relay are arranged on a neutral side of the relay coil.

* * * * *